US011080984B1

(12) United States Patent
Piccolo, III

(10) Patent No.: US 11,080,984 B1
(45) Date of Patent: Aug. 3, 2021

(54) SYSTEMS AND METHODS FOR CONTROLLING COMBINED INITIATING DEVICE AND NOTIFICATION APPLIANCE CIRCUITS

(71) Applicant: Johnson Controls Fire Protection LP, Boca Raton, FL (US)

(72) Inventor: Joseph Piccolo, III, Fitzwilliam, NH (US)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 16/904,299

(22) Filed: Jun. 17, 2020

(51) Int. Cl.

| | |
|---|---|
| ***G08B 25/00*** | (2006.01) |
| ***G08B 29/06*** | (2006.01) |
| ***G08B 3/10*** | (2006.01) |
| ***G08B 17/02*** | (2006.01) |
| ***G08B 5/22*** | (2006.01) |
| ***G08B 17/10*** | (2006.01) |

(52) U.S. Cl.
CPC ..... *G08B 25/008* (2013.01); *G08B 3/10* (2013.01); *G08B 5/22* (2013.01); *G08B 17/02* (2013.01); *G08B 17/10* (2013.01); *G08B 29/06* (2013.01)

(58) Field of Classification Search
CPC ..... G08B 25/008; G08B 5/22; G08B 3/10; G08B 29/06; G08B 17/10; G08B 17/02
See application file for complete search history.

(56) References Cited

U.S. PATENT DOCUMENTS

| | | | | | |
|---|---|---|---|---|---|
| 5,966,002 | A * | 10/1999 | Barrieau | G08B 17/10 | 323/222 |
| 6,426,697 | B1 * | 7/2002 | Capowski | G08B 3/10 | 340/3.1 |
| 6,459,370 | B1 * | 10/2002 | Barrieau | G08B 29/06 | 324/522 |
| 6,567,001 | B1 * | 5/2003 | Barrieau | G08B 29/06 | 340/3.1 |
| 9,761,099 | B1 * | 9/2017 | Barth | G08B 13/08 | |
| 2007/0262857 | A1 * | 11/2007 | Jackson | G06T 7/70 | 340/506 |
| 2014/0270714 | A1 * | 9/2014 | Osminer | H04N 21/4147 | 386/296 |
| 2015/0022346 | A1 * | 1/2015 | Fadell | G05B 11/01 | 340/533 |
| 2016/0071402 | A1 * | 3/2016 | Chiarizio | H04B 1/713 | 340/539.17 |

(Continued)

*Primary Examiner* — Ojiako K Nwugo
(74) *Attorney, Agent, or Firm* — Arent Fox LLP

(57) ABSTRACT

Aspects of the present disclosure provide non-addressable detection and alarm systems and methods for controlling a combined circuit by a control panel. In an example, a combined circuit may include paired wires, one or more initiating devices, and one or more notification appliances communicatively coupled with the paired wires in parallel. The control panel may monitor the one or more initiating devices in a standby mode while maintaining the one or more notification appliances in an off state. When the control panel detects an anomaly from one or more initiating devices, the control panel may switch the combined circuit to an alarm mode. In the alarm mode, the control panel may activate the one or more notification appliances and maintain the one or more initiating devices in an off state.

20 Claims, 6 Drawing Sheets

(56) References Cited

U.S. PATENT DOCUMENTS

| | | | | |
|---|---|---|---|---|
| 2018/0122221 | A1* | 5/2018 | Norton | G08B 25/08 |
| 2020/0150264 | A1* | 5/2020 | Barson | G08B 13/08 |
| 2020/0327799 | A1* | 10/2020 | Barson | G08B 17/10 |
| 2020/0402380 | A1* | 12/2020 | Barson | G08B 5/36 |

* cited by examiner

SYSTEMS AND METHODS FOR CONTROLLING COMBINED INITIATING DEVICE AND NOTIFICATION APPLIANCE CIRCUITS

TECHNICAL FIELD

The present disclosure generally relates to systems and methods for detection and alarm systems, in particular systems and methods for controlling combined initiating device and notification appliance circuits.

BACKGROUND

Detection and alarm systems such as fire detection and alarm systems are often used at public and private premises, such as households, commercial buildings, businesses, retail establishments, schools, hospitals and government buildings, to list a few examples. In general the detection and alarm systems are divided into two types of systems: addressable systems and non-addressable systems. Addressable systems use addressable devices which may allow control panels to communicate and control specific devices in the system due to device labeling. Non-addressable systems do not include addressable devices and therefore rely on control panels to send signals to one or more of initiating device circuits or one or more of notification appliance circuits in the systems. While non-addressable systems may be less complex and cost effective alternatives to addressable systems, there is a need for more efficient and cost effective solutions for non-addressable systems.

SUMMARY

The following presents a simplified summary of one or more implementations of the present disclosure in order to provide a basic understanding of such implementations. This summary is not an extensive overview of all contemplated implementations, and is intended to neither identify key or critical elements of all implementations nor delineate the scope of any or all implementations. The sole purpose of this summary is to present some concepts of one or more implementations of the present disclosure in a simplified form as a prelude to the more detailed description that is presented later.

In an aspect, a non-addressable detection and alarm system is provided. The system may include a combined circuit including paired wires, one or more initiating devices, and one or more notification appliances communicatively coupled with the paired wires in parallel. The system may also include a control panel controller communicatively coupled with the combined circuit. The controller may be configured to monitor the one or more initiating devices in a standby mode having a first polarity output on the paired wires. The controller may also be configured to maintain the one or more notification appliances in an off state in the standby mode. The controller may also be configured to detect an anomaly from an initiating device of the one or more initiating devices in the standby mode. The controller may also be configured to switch the combined circuit from the standby mode to an alarm mode having a second polarity output on the paired wires in response to the anomaly from the initiating device. The controller may also be configured to activate the one or more notification appliances in the alarm mode. The controller may also be configured to maintain the one or more initiating devices in an off state in the alarm mode.

In another aspect, a method of controlling, by a control panel, a combined circuit including paired wires, one or more initiating devices, and one or more notification appliances communicatively coupled with the paired wires in parallel, is provided. The method may include monitoring the one or more initiating devices in a standby mode having a first polarity output on the paired wires of the combined circuit. The method may also include maintaining the one or more notification appliances in an off state in the standby mode. The method may also include detecting an anomaly from an initiating device of the one or more initiating devices in the standby mode. The method may also include switching the combined circuit from the standby mode to an alarm mode having a second polarity output on the paired wires in response to the anomaly from the initiating device. The method may also include activating the one or more notification appliances in the alarm mode. The method may also include maintaining the one or more initiating devices in an off state in the alarm mode.

In another aspect, a non-transitory computer-readable medium storing instructions for controlling, by a control panel, a combined circuit including paired wires, one or more initiating devices, and one or more notification appliances communicatively coupled with the paired wires in parallel, is provided. The computer-readable medium may include instructions to monitor the one or more initiating devices in a standby mode having a first polarity output on the paired wires of the combined circuit; maintain the one or more notification appliances in an off state in the standby mode. The computer-readable medium may also include instructions to detect an anomaly from an initiating device of the one or more initiating devices in the standby mode. The computer-readable medium may include instructions to switch the combined circuit from the standby mode to an alarm mode having a second polarity output on the paired wires in response to the anomaly from the initiating device. The computer-readable medium may include instructions to activate the one or more notification appliances in the alarm mode. The computer-readable medium may include instructions to maintain the one or more initiating devices in an off state in the alarm mode.

Additional advantages and novel features relating to implementations of the present disclosure will be set forth in part in the description that follows, and in part will become more apparent to those skilled in the art upon examination of the following or upon learning by practice thereof.

DESCRIPTION OF THE FIGURES

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advances thereof, will be best understood by reference to the following detailed description of illustrative aspects of the disclosure when read in conjunction with the accompanying drawings, wherein:

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

In a typical non-addressable detection and alarm system, a control panel monitors different zones of a building, where each zone includes an initiating device circuit having a plurality of initiating devices and a notification appliance circuit having a plurality of notification appliances. In the typical system, once a single initiating device detects an anomaly, such as fire, smoke, or a pull switch, on the initiating device circuit, the control panel signals to the notification appliances on the notification appliance circuit to send out an alarm. Use of separate circuits allows for a simple system using hardware for control panels, initiating devices, and notification appliances that are cheaper due to the non-addressable features, thereby allowing a low cost system, as compared to addressable systems.

Aspects of the present disclosure provide non-addressable detection and alarm systems and methods for controlling a combined circuit, including both initiating devices and notification appliances, by a control panel. Use of the systems and methods provided herein may reduce the overall complexity and installation cost and allow for the detection of multiple initiating devices in a zone.

In the present disclosure a detection and alarm system is provided to include the control panel and the combined circuit having one or more initiating devices and one or more notification appliances. Examples of the initiating devices include, but are not limited to, smoke detectors, heat detectors, pull switches, or call points. Examples of the notification appliances include, but are not limited to, audible alarms such as horns or visual alarms such as strobe lights. Control of a combined circuit by the control panel may reduce complexity of detection and alarm systems and may also reduce an overall cost of the detection and alarm system.

Turning now to the figures, example aspects are depicted with reference to one or more components described herein, where components in dashed lines may be optional.

Figure 1A:
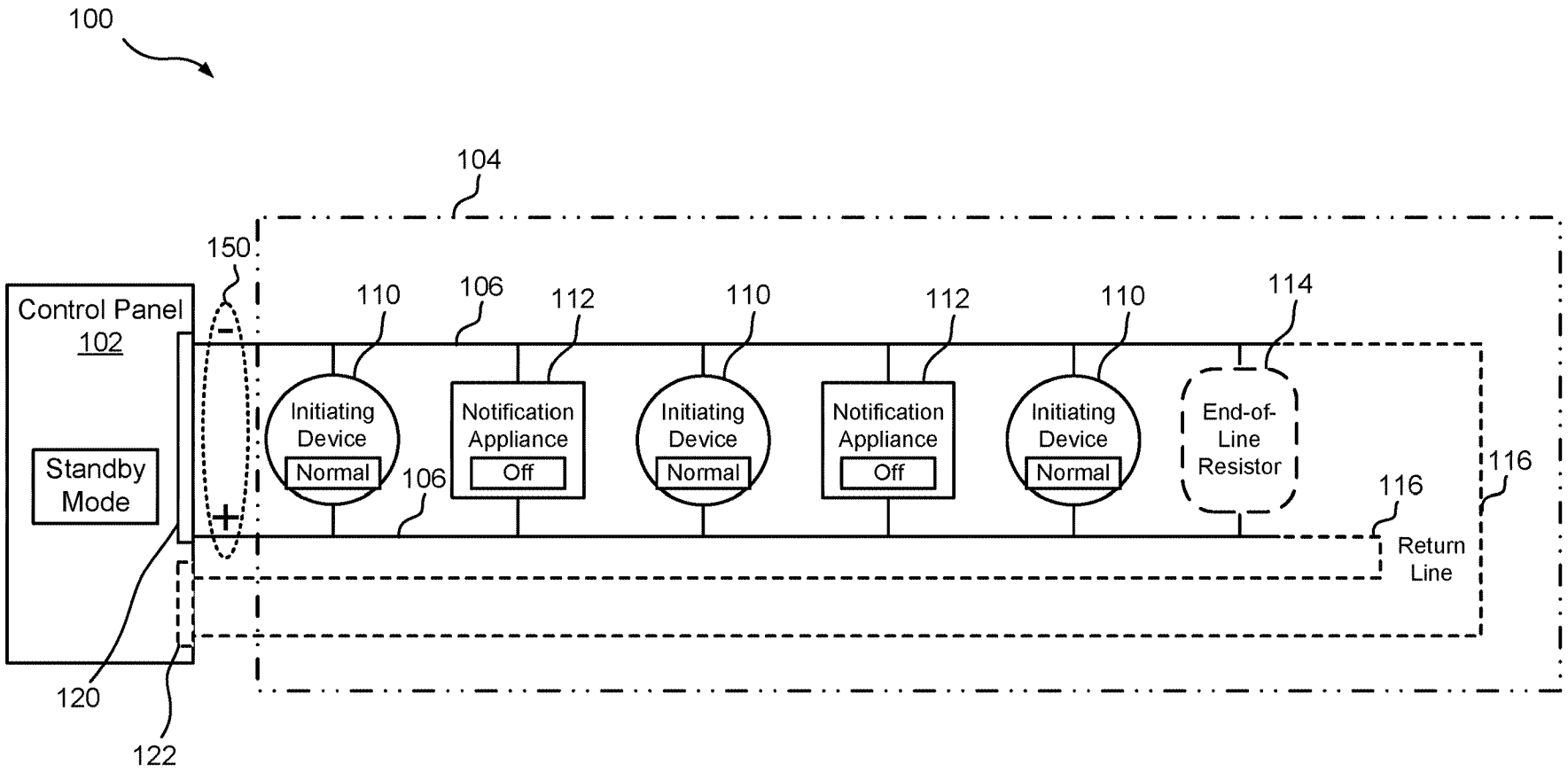
FIGS. 1A-1C illustrate conceptual views of an example detection and alarm system in different modes, in accordance with aspects of the present disclosure.
Figure 1B:
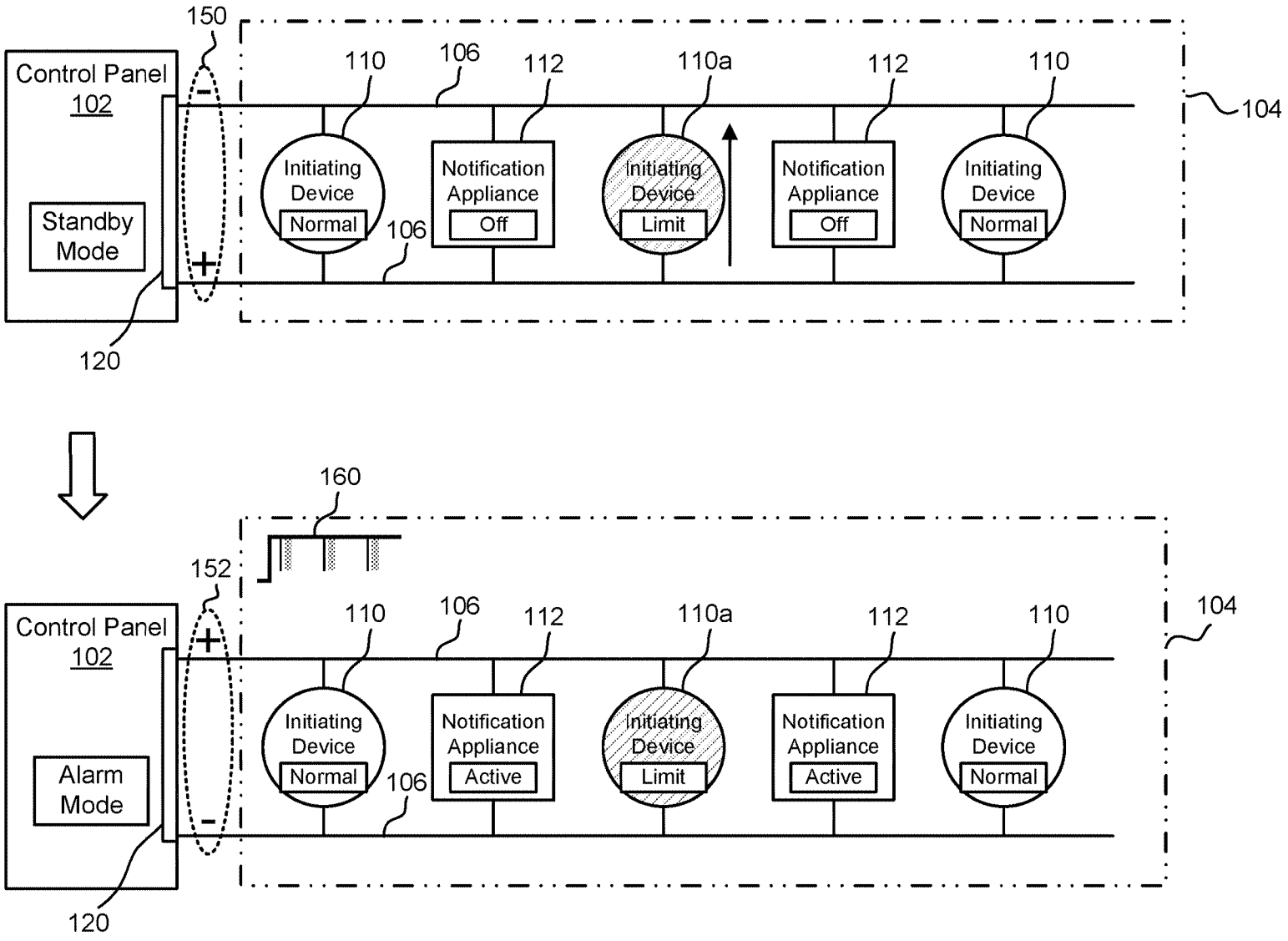
Figure 1C:
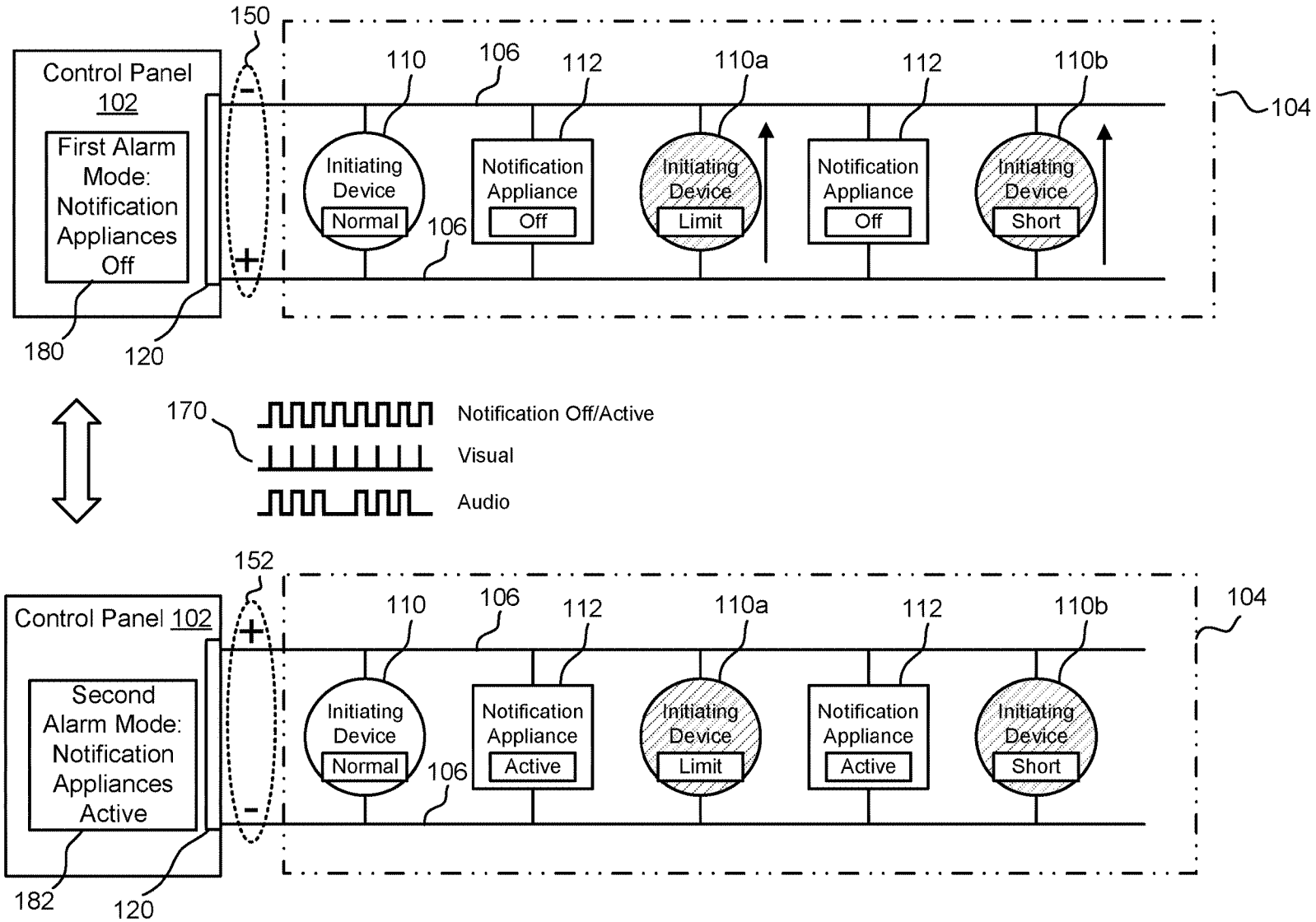

Referring to FIG. 1A-1C, an example detection and alarm system 100 is depicted in different modes including a standby mode and an alarm mode. In an aspect, the detection and alarm system 100 may include a control panel 102 communicatively coupled with a combined circuit 104. The combined circuit 104 may include one or more initiating devices 110 and one or more notification appliances 112 connected in parallel between paired wires 106. In an example, the combined circuit 104 may communicatively couple with the control panel 102 via a primary interface 120.

In an example, the combined circuit 104 may also include an end-of-line resistor 114 communicatively coupled between the paired wires 106 in parallel with the one or more initiating devices 110 and the one or more notification appliances 112. The end-of-line resistor 114 may allow the control panel 102 to monitor for a cut or broken wire of the paired wires 106. In an example, the control panel 102 monitors an amount of current that passes through the paired wires 106 due to the end-of-line resistor 114, and when the current is removed, the control panel 102 determines that a wire of the paired wire 106 is cut or broken. The combined circuit 104 including the end-of-line resistor 114 may be known as a Class B configuration.

In an alternative configuration, the combined circuit 104 may not include the end-of-line resistor 114. Instead, the combined circuit may include a return line 116 communicatively coupled between the paired wires 106 and a secondary interface 122 of the control panel 102. The return line 116 may allow the detection and alarm system 100 to continue communications with the initiating devices 110 and the notification appliances 112 when a wire of the paired wire 106 is cut or broken. The combined circuit 104 including the return line 116 (and without the end-of-line resistor 114) may be known as a Class A configuration.

As either configuration may be used without change to the combined circuit 104, further description and illustration of the end-of-line resistor 114 or the return line 116 is not provided in the following examples.

In an aspect, the control panel 102 may operate in a standby mode, as illustrated by FIG. 1A, in which a first polarity 150 is output by the control panel 102 on the paired wires 106. In the standby mode, the notification appliances 112 are in an off state, and the initiating devices 110 are in a normal state (or "on state"). While the initiating devices 110 are in the normal state, the control panel 102 may monitor the initiating devices 110 to determine whether an anomaly such as fire, smoke, or a pull switch is detected.

When an anomaly has been detected, the initiating devices 110 increase current to indicate the presence of the anomaly to the control panel 102. For example, a pull switch may short the connection between the paired wires 106 thereby indicating to the control panel 102 that the pull switch has been pulled by a person. In another example, a smoke detector may place a load on the connection between the paired wires 106 thereby increasing current on the paired wires 106 and indicating to the control panel 102 that smoke has been detected by the smoke detector. In an example, the control panel 102 may compare the current on the paired wires 106 to a threshold range, and if the current is within the threshold range, the control panel 102 may identify the initiating device 110 as a first type of initiating device (e.g., smoke detector), and when the current is above the threshold range, the control panel 102 may identify the initiating device 110 as a second type of initiating device (e.g., pull switch).

Referring to FIG. 1B, the initiating device 110*a* (e.g., smoke detector) may set a load on the connection between the paired wires 106 when the control panel is in standby mode. The increase in current causes the control panel 102 to transition to an alarm mode.

In the alarm mode, a second polarity 152 is output by the control panel 102 on the paired wires 106 switching the notification appliances 112 to an active state and the initiating devices 110 to an off state (or standby state). The control panel 102 may thereby transmit a notification signal 160 to control the notification appliances 112. In an example, the notification signal 160 may be configured to synchronize the notification appliances 112 such that the strobes are synchronized with each other and/or the horns are synchronized with each other. As the initiating devices 110 are in an off state, no changes are detected by these devices in the alarm mode.

In another aspect, the detection and alarm system 100 may use an alternating alarm operation, as illustrated by FIG. 1C. According to this aspect, in the alarm mode, the control panel 102 may alternate between the first polarity 150 and the second polarity 152 on the paired wires 106 using the notification signal 170 to switch between a first alarm mode 180 and a second alarm mode 182. In the first alarm mode 180, the initiating devices 110 are in a normal state (or on state) to allow these devices to continue detecting anomalies while the notification appliances 112 are in an off state (or standby state). As shown by FIG. 1C, in the first alarm mode 180, a second initiating device 110*b* may detect an anomaly (e.g., short from pull switch) thereby confirming the anomaly detected by the first initiating device 110*a*.

In the second alarm mode 182, the notification appliances 112 are in an active state (or on state) to allow the appliances to continue providing an alert of the anomaly while the initiating devices 110 are in an off state (or standby state). The notification signal 170 transmitted by the control panel 102 may thereby allow the control panel 102 to switch to the monitoring of the initiating devices 110 when the notification appliances 112 are not outputting an alarm (e.g., sound or light). In an example, the notification signal 170 may be configured to switch between the first alarm mode 180 and the second alarm mode 182 using a pulsed signal, as illustrated by FIG. 1C. In an example, the first alarm mode 180 may be activated when the pulse is low or at a logic "0" and the second alarm mode 182 may be activated when the pulse is high or at a logic "1." Further, different notification appliances 112 may synchronize based on a rise of pulse or a number of pulses.

The non-addressable detection and alarm system 100 disclosed herein may reduce installation complexity and costs due to the use of a combined circuit including a paired wire line being run for both initiating devices and notification appliances. The detection and alarm system 100 provides flexibility by supporting both Class A and Class B configurations, as described herein. While initiating devices 110 and notification appliances 112 are configured to handle the switching between modes and polarities (e.g., including polarity switching circuits and/or diodes), and therefore are not typical off-the shelf devices or appliances, the non-addressable detection and alarm system 100 described herein provides a simplified layout, a simplified wiring scheme, a simplified panel equipment (e.g., equipment for one circuit instead of two circuits), and allows for less labor for installation, as compared to typical systems.

Figure 2:
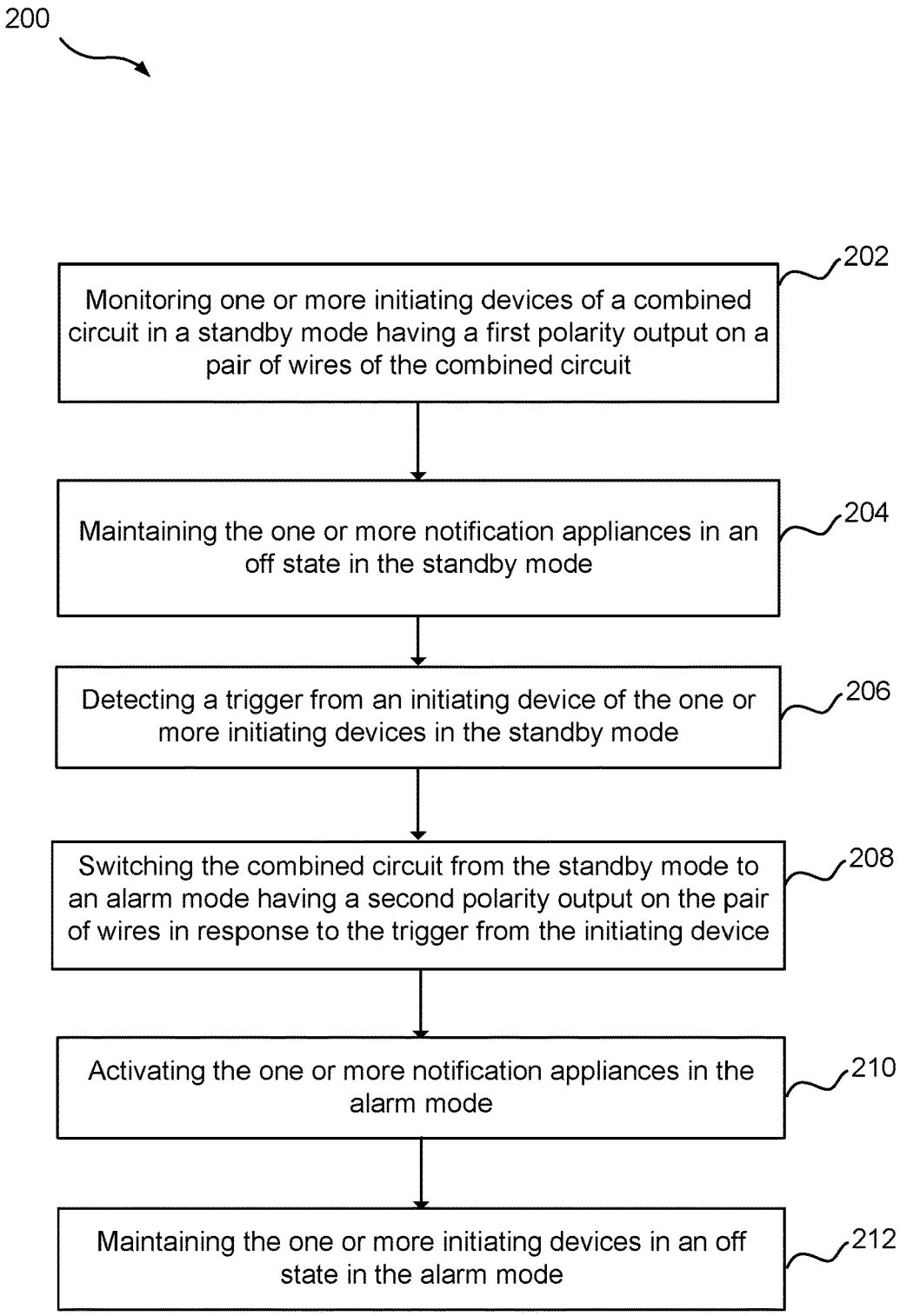
FIG. 2 is a flowchart of an example method of operation by the detection and alarm system of FIGS. 1A-1C, in accordance with aspects of the present disclosure.

Referring to FIG. 2, an example method 200 of the operation of and interactions between various modules of the detection and alarm system 100 is disclosed. FIGS. 1A-1C may be referenced in combination with the flowchart of FIG. 2. In an example, the method 200 is implemented by one or more of the control panel 102, a computer system (e.g., computer system 300 of FIG. 3), a controller (e.g., processor 304 of FIG. 3), and/or one or more components/sub components.

At 202, the method 200 may include monitoring one or more initiating devices of a combined circuit in a standby mode having a first polarity output on paired wires of the combined circuit. In an example, one or more of the control panel 102, the computer system 300, the processor 304, and/or one or more components/subcomponents monitor the one or more initiating devices 110 of the combined circuit 104 in a standby mode having a first polarity 150 output on the paired wires 106 of the combined circuit 104, as illustrated by FIG. 1A.

At 204, the example method 200 also includes maintaining the one or more notification appliances in an off state in the standby mode. In an example, one or more of the control panel 102, the computer system 300, the processor 304, and/or one or more components/subcomponents maintain the one or more notification appliances 112 in an off state in the standby mode, as illustrated by FIG. 1A.

At 206, the example method 200 also includes detecting an anomaly from an initiating device of the one or more initiating devices in the standby mode. In an example, one or more of the control panel 102, the computer system 300, the processor 304, and/or one or more components/subcomponents detects an anomalyfrom an initiating device 110*a* of the one or more initiating devices 110 in the standby mode. For example, the one or more of the control panel 102, the computer system 300, the processor 304, and/or one or more components/subcomponents may detect an anomaly based on an increase of current on the paired wire 106.

In an aspect, once the anomaly is detected, the one or more of the control panel 102, the computer system 300, the processor 304, and/or one or more components/subcomponents may compare the increase of current to a threshold range, and if the increase in current is within the threshold range, the one or more of the control panel 102, the computer system 300, the processor 304, and/or one or more components/subcomponents may determine that the initiating device 110*a* is a current limiting device such as a smoke detector. If the increase in current is greater than the threshold range, the one or more of the control panel 102, the computer system 300, the processor 304, and/or one or more components/subcomponents may determine that the initiating device 110*a* is a shorting device such as a pull switch.

At 208, the example method 200 also includes switching the combined circuit from the standby mode to an alarm mode having a second polarity output on the paired wires in response to the anomaly from the initiating device. In an example, one or more of the control panel 102, the computer system 300, the processor 304, and/or one or more components/subcomponents switches the combined circuit 104 from the standby mode to an alarm mode having a second polarity 152 output on the paired wires 106 in response to the anomaly from the initiating device 110*a*.

At 210, the example method 200 also includes activating the one or more notification appliances in the alarm mode. In an example, one or more of the control panel 102, the computer system 300, the processor 304, and/or one or more components/subcomponents activate the one or more notification appliances 112 in the alarm mode, as illustrated by FIG. 1B. For example, the switched polarity (e.g., second polarity 152) of the combined circuit may activate the notification appliances 112 in the alarm mode. Further, the one or more of the control panel 102, the computer system 300, the processor 304, and/or one or more components/subcomponents may transmit a signal such as signals 160 or 170 to control the combined circuit 104.

At 212, the example method 200 also includes maintaining the one or more initiating devices in an off state in the alarm mode. In an example, one or more of the control panel 102, the computer system 300, the processor 304, and/or one or more components/subcomponents maintaining the one or more initiating devices 110 in an off state in the alarm mode. For example, the switched polarity (e.g., second polarity 152) of the combined circuit may deactivate the initiating devices 110 in the alarm mode.

In another aspect, the the alarm mode includes a first alarm mode 180 having the first polarity output 150 on the paired wires 106 and a second alarm mode 182 having the second polarity 152 output on the paired wires 106. The method further includes switching between the first alarm mode 180 and the second alarm mode 182 such that the one or more initiating devices 110 are monitored in the first alarm mode 180 and the one or more notification appliances 112 are active in the second alarm mode 182 based on the signal 170.

Figure 3:
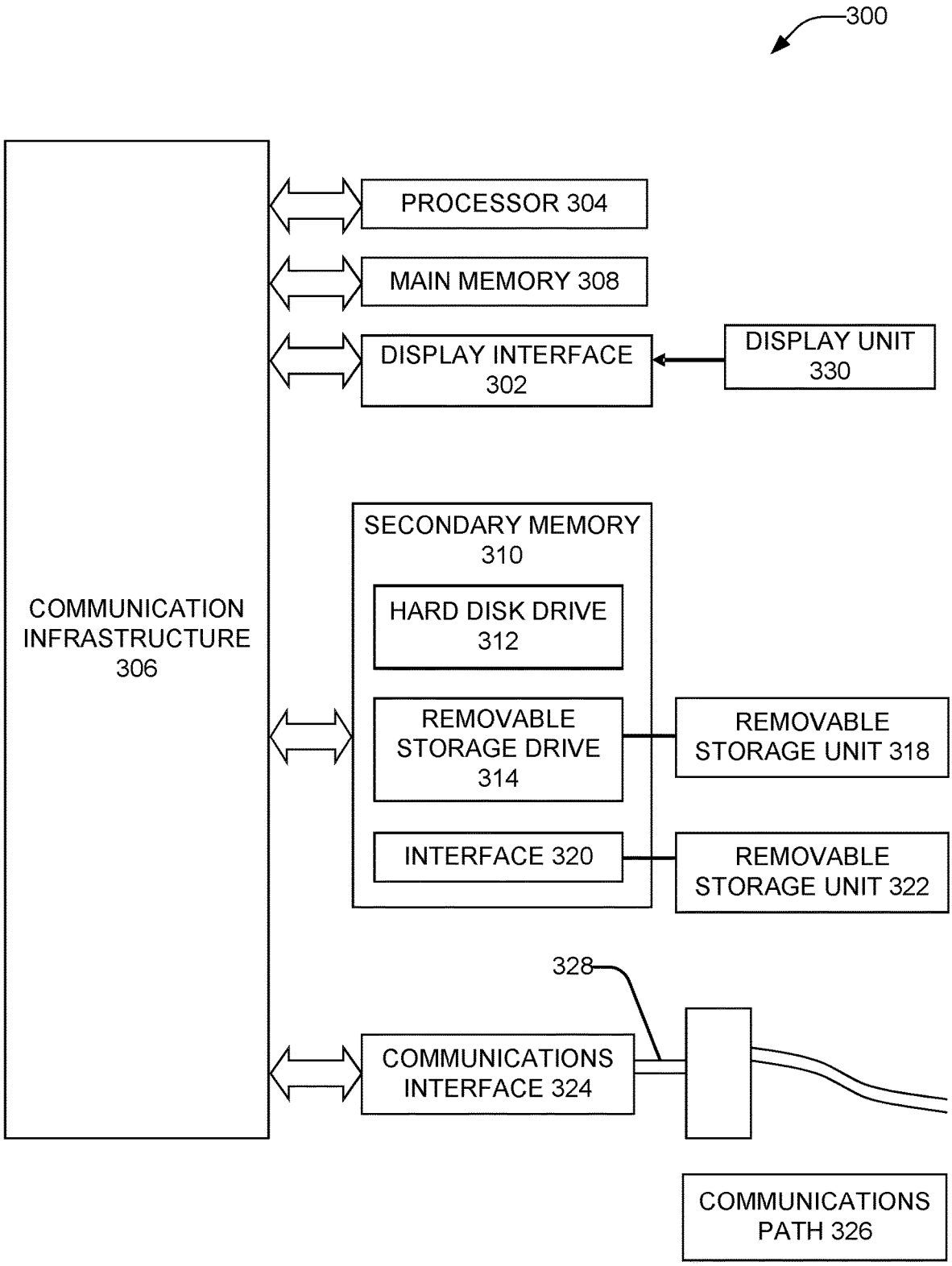
FIG. 3 is a block diagram of an example of various hardware components and other features of a computer system that operate the detection and alarm system of FIGS. 1A-1C, in accordance with aspects of the present disclosure.

Aspects of the present disclosure may be implemented using hardware, software, or a combination thereof and may be implemented in one or more computer systems or other processing systems. In one aspect, the disclosure is directed toward one or more computer systems capable of carrying out the functionality described herein. FIG. 3 presents an example system diagram of various hardware components and other features that may be used in accordance with aspects of the present disclosure. Aspects of the present disclosure may be implemented using hardware, software, or a combination thereof and may be implemented in one or more computer systems or other processing systems. In one example variation, aspects of the disclosure are directed toward one or more computer systems capable of carrying out the functionality described herein. An example of such a computer system 300 is shown in FIG. 3. In an example, the computer system 300 may be an example of the control panel 102, described herein.

The computer system 300 includes one or more processors, such as the processor 304. The processor 304 is connected to the communication infrastructure 306 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

The processor 304, or any other "processor," as used herein, processes signals and performs general computing and arithmetic functions. Signals processed by the processor 304 may include digital signals, data signals, computer instructions, processor instructions, messages, a bit, a bit stream, or other computing that may be received, transmitted and/or detected.

The communication infrastructure 306 refers to an interconnected architecture that is operably connected to transfer data between computer components within a singular or multiple systems. The bus may be a memory bus, a memory controller, a peripheral bus, an external bus, a crossbar switch, and/or a local bus, among others.

Further, the connection between components of the computer system 300, or any other type of connection between computer-related components described herein may be referred to an operable connection, and may include a connection by which entities are operably connected, such that signals, physical communications, and/or logical communications may be sent and/or received. An operable connection may include a physical interface, a data interface and/or an electrical interface.

The computer system 300 may include a display interface 302 that forwards graphics, text, and other data from the communication infrastructure 306 (or from a frame buffer not shown) for display on a display unit 330. The computer system 300 also includes a main memory 308, preferably random access memory (RAM), and may also include a secondary memory 310. The secondary memory 310 may include, for example, a hard disk drive 312 and/or a removable storage drive 314, representing a floppy disk drive, a magnetic tape drive, an optical disk drive, etc. The removable storage drive 314 reads from and/or writes to a removable storage unit 318 in a well-known manner. The removable storage unit 318, represents a floppy disk, magnetic tape, optical disk, etc., which is read by and written to removable storage drive 314. As will be appreciated, the removable storage unit 318 includes a computer usable storage medium having stored therein computer software and/or data.

In alternative aspects, the secondary memory 310 may include other similar devices for allowing computer programs or other instructions to be loaded into the computer system 300. Such devices may include, for example, a removable storage unit 322 and an interface 320. Examples of such may include a program cartridge and cartridge interface (such as that found in video game devices), a removable memory chip (such as an erasable programmable read only memory (EPROM), or programmable read only memory (PROM)) and associated socket, and other removable storage units 322 and interfaces 320, which allow software and data to be transferred from the removable storage unit 322 to the computer system 300.

It should be understood that a memory, as used herein may include volatile memory and/or non-volatile memory. Non-volatile memory may include, for example, ROM (read only memory), PROM (programmable read only memory), EPROM (erasable PROM) and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDR SDRAM), and/or direct RAM bus RAM (DRRAM).

The computer system 300 may also include a communications interface 324. In an example, the communications interface 324 may be an example of the primary interface 120 and/or the secondary interface 122, described herein. The communications interface 324 allows software, data, power, or signals to be transferred between computer system 300 and the initiating devices 110, notification appliances 112, and/or external devices. Examples of the communications interface 324 may include a modem, a network interface (such as an Ethernet card), a communications port, a Personal Computer Memory Card International Association (PCMCIA) slot and card, etc. Software and data transferred via the communications interface 324 are in the form of signals 328, which may be electronic, electromagnetic, optical or other signals capable of being received by communications interface 324. These signals 328 are provided to the communications interface 324 via a communications path (e.g., channel) 326. This path 326 carries signals 328 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 314, a hard disk installed in hard disk drive 312, and the signals 328. These computer program products provide software to the computer system 300. Aspects of the disclosure are directed to such computer program products.

Computer programs (also referred to as computer control logic) are stored in the main memory 308 and/or the secondary memory 310. Computer programs may also be received via the communications interface 324. Such computer programs, when executed, enable the computer system 300 to perform various features in accordance with aspects of the present disclosure, as discussed herein. In particular, the computer programs, when executed, enable the processor 304 to perform the methods and techniques described herein. Accordingly, such computer programs represent controllers of the computer system 300.

In variations where aspects of the disclosure are implemented using software, the software may be stored in a computer program product and loaded into the computer system 300 using the removable storage drive 314, the hard drive 312, or the communications interface 320. The control logic (software), when executed by the processor 304, causes the processor 304 to perform the functions in accordance with aspects of the disclosure as described herein. In another variation, aspects are implemented primarily in hardware using, for example, hardware components, such as application specific integrated circuits (ASICs), primary logic devices (PLDs), or other programmable chips. Implementation of the hardware state machine so as to perform the functions described herein will be apparent to persons skilled in the relevant art(s).

In yet another example variation, aspects of the disclosure are implemented using a combination of both hardware and software.

Figure 4:
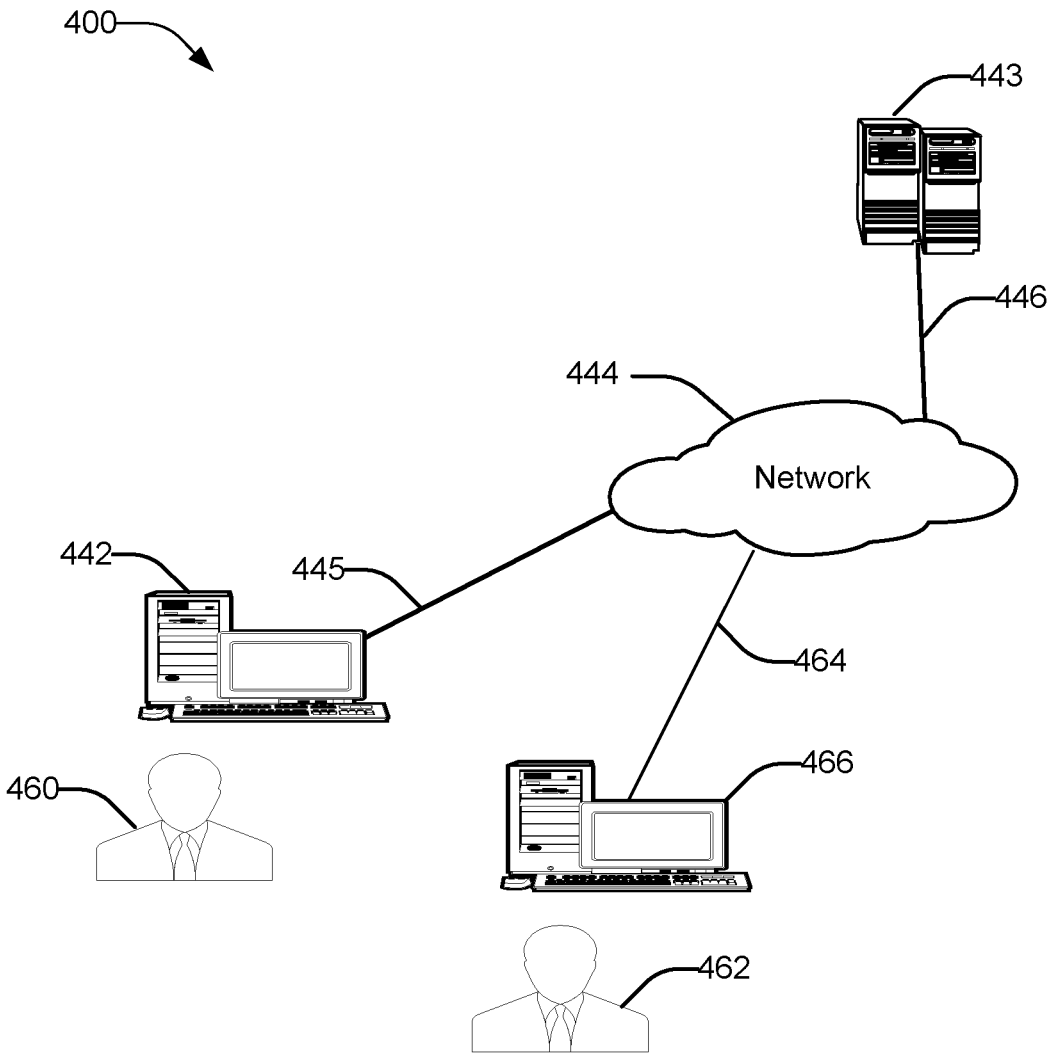
FIG. 4 is a block diagram of various example system components that implement the detection and alarm system of FIGS. 1A-1C, for use in accordance with aspects of the present disclosure.

FIG. 4 is a block diagram of various example system components that may be used in accordance with aspects of the present disclosure. For example, the various components may be within the detection and alarm system 100, or only some of the components may be within the detection and alarm system 100, and other components may be remote from the detection and alarm system 100. The system 400 includes one or more accessors 460, 462 (also referred to interchangeably herein as one or more "users" or persons seeking to gain access to a location) and one or more terminals 442, 466 (such terminals may be or include, for example, various features of the control panel 102 and/or computer system 300). In one aspect, data for use in accordance with aspects of the present disclosure is, for example, input and/or accessed by accessors 460, 462 via terminals 442, 466, such as personal computers (PCs), minicomputers, mainframe computers, microcomputers, telephonic devices, or wireless devices, such as personal digital assistants ("PDAs") or a hand-held wireless devices coupled to a server 443, such as a PC, minicomputer, mainframe computer, microcomputer, or other device having a processor and a repository for data and/or connection to a repository for data, via, for example, a network 444, such as the Internet or an intranet, and couplings 445, 446, 464. The couplings 445, 446, 464 include, for example, wired, wireless, or fiber optic links. In another example variation, the method and system in accordance with aspects of the present disclosure operate in a stand-alone environment, such as on a single terminal.

The aspects of the disclosure discussed herein may also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media may include volatile and nonvolatile, transitory and non-transitory media, removable and non-removable media implemented in any method or technology for storage of information such as computer readable instructions, data structures, modules or other data.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A detection and alarm system, comprising:

a combined circuit including paired wires, one or more initiating devices, and one or more notification appliances communicatively coupled with the paired wires in parallel; and a control panel having a controller communicatively coupled with the combined circuit, the controller configured to:

monitor the one or more initiating devices in a standby mode having a first polarity output on the paired wires;

maintain the one or more notification appliances in an off state in the standby mode;

detect an anomaly from an initiating device of the one or more initiating devices in the standby mode;

switch the combined circuit from the standby mode to an alarm mode having a second polarity output on the paired wires in response to the anomaly from the initiating device;

activate the one or more notification appliances in the alarm mode; and maintain the one or more initiating devices in an off state in the alarm mode.

2. The detection and alarm system of claim 1, wherein the controller is further configured to:

transmit a signal to control the one or more notification appliances in the alarm mode.

3. The detection and alarm system of claim 1, wherein the alarm mode includes a first alarm mode having the first polarity output on the paired wires and a second alarm mode having the second polarity output on the paired wires, and wherein the controller is further configured to switch between the first alarm mode and the second alarm mode such that the one or more initiating devices are monitored in the first alarm mode and the one or more notification appliances are active in the second alarm mode.

4. The detection and alarm system of claim 1, further comprising:

an end-of-line resistor connected in parallel between the paired wires, wherein the one or more initiating devices and the one or more notification appliances are communicatively coupled along the paired wires between the end-of-line resistor and the controller.

5. The detection and alarm system of claim 1, wherein the combined circuit is communicatively coupled with the controller at a primary interface, and wherein the detection and alarm system further comprise a return line communicatively coupled with the combined circuit and the controller at a secondary interface.

6. The detection and alarm system of claim 1, wherein the one or more initiating devices comprise one or more pull switches or one or more fire detectors.

7. The detection and alarm system of claim 1, wherein the one or more notification appliances comprise one or more visual alarms or one or more audio alarms.

8. A method of controlling, by a control panel, a combined circuit including paired wires, one or more initiating devices, and one or more notification appliances communicatively coupled with the paired wires in parallel, the method comprising:

monitoring the one or more initiating devices in a standby mode having a first polarity output on the paired wires of the combined circuit;

maintaining the one or more notification appliances in an off state in the standby mode;

detecting an anomaly from an initiating device of the one or more initiating devices in the standby mode;

switching the combined circuit from the standby mode to an alarm mode having a second polarity output on the paired wires in response to the anomaly from the initiating device;

activating the one or more notification appliances in the alarm mode; and maintaining the one or more initiating devices in an off state in the alarm mode.

9. The method of claim 8, further comprising:

transmit a signal to control the one or more notification appliances in the alarm mode.

10. The method of claim 8, wherein the alarm mode includes a first alarm mode having the first polarity output on the paired wires and a second alarm mode having the second polarity output on the paired wires, and wherein the method further comprises switching between the first alarm mode and the second alarm mode such that the one or more initiating devices are monitored in the first alarm mode and the one or more notification appliances are active in the second alarm mode.

11. The method of claim 8, wherein the combined circuit further includes an end-of-line resistor connected in parallel between the paired wires, wherein the one or more initiating devices and the one or more notification appliances are communicatively coupled along the paired wires between the end-of-line resistor and the control panel.

12. The method of claim 8, wherein the combined circuit is communicatively coupled with the control panel at a primary interface, and wherein the combined circuit further includes a return line communicatively coupled with the combined circuit and the control panel at a secondary interface.

13. The method of claim 8, wherein the one or more initiating devices comprise one or more pull switches or one or more smoke detectors.

14. The method of claim 8, wherein the one or more notification appliances comprise one or more visual alarms or one or more audio alarms.

15. A non-transitory computer-readable medium storing instructions for controlling, by a control panel, a combined circuit including paired wires, one or more initiating devices, and one or more notification appliances communicatively coupled with the paired wires in parallel, the non-transitory computer-readable medium comprising instructions to:

monitor the one or more initiating devices in a standby mode having a first polarity output on the paired wires of the combined circuit;

maintain the one or more notification appliances in an off state in the standby mode;

detect an anomaly from an initiating device of the one or more initiating devices in the standby mode;

switch the combined circuit from the standby mode to an alarm mode having a second polarity output on the paired wires in response to the anomaly from the initiating device;

activate the one or more notification appliances in the alarm mode; and maintain the one or more initiating devices in an off state in the alarm mode.

16. The non-transitory computer-readable medium of claim 15, further comprising instructions to:

transmit a signal sent to control the one or more notification appliances in the alarm mode.

17. The non-transitory computer-readable medium of claim 15, wherein the alarm mode includes a first alarm mode having the first polarity output on the paired wires and a second alarm mode having the second polarity output on the paired wires, and wherein the non-transitory computer-readable medium further comprising instructions to switch between the first alarm mode and the second alarm mode such that the one or more initiating devices are monitored in the first alarm mode and the one or more notification appliances are active in the second alarm mode.

18. The non-transitory computer-readable medium of claim 15, wherein the combined circuit further includes an end-of-line resistor connected in parallel between the paired wires, wherein the one or more initiating devices and the one or more notification appliances are communicatively coupled along the paired wires between the end-of-line resistor and the control panel.

19. The non-transitory computer-readable medium of claim 15, wherein the combined circuit is communicatively coupled with the control panel at a primary interface, and wherein the combined circuit further includes a return line communicatively coupled with the combined circuit and the control panel at a secondary interface.

20. The non-transitory computer-readable medium of claim 15, wherein the one or more initiating devices comprise one or more pull switches or one or more smoke detectors, and the one or more notification appliances comprise one or more visual alarms or one or more audio alarms.

* * * * *